US007980859B2

(12) United States Patent
Mizumura et al.

(10) Patent No.: US 7,980,859 B2
(45) Date of Patent: Jul. 19, 2011

(54) FLOATING CONNECTOR HOLDER

(75) Inventors: Akinori Mizumura, Yamato (JP); Teruhito Suzuki, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/224,083

(22) PCT Filed: Feb. 20, 2007

(86) PCT No.: PCT/IB2007/002130

§ 371 (c)(1),
(2), (4) Date: Dec. 22, 2008

(87) PCT Pub. No.: WO2008/004122

PCT Pub. Date: Jan. 10, 2008

(65) Prior Publication Data

US 2009/0305544 A1 Dec. 10, 2009

(30) Foreign Application Priority Data

Feb. 17, 2006 (JP) ..... 2006-041048

(51) Int. Cl.
*H01R 12/00* (2006.01)

(52) U.S. Cl. ..... 439/63; 439/248

(58) Field of Classification Search ..... 439/63, 439/581, 247, 248, 326, 826, 827, 833, 836, 439/843, 844, 878, 881, 883
See application file for complete search history.

(56) References Cited

U.S. PATENT DOCUMENTS

| | | | | |
|---|---|---|---|---|
| 3,514,737 | A * | 5/1970 | Renshaw, Jr | 439/63 |
| 3,828,298 | A * | 8/1974 | Schumacher | 439/442 |
| 3,915,535 | A * | 10/1975 | O'Keefe et al. | 439/63 |
| 4,029,384 | A * | 6/1977 | Reinwall, Jr. | 439/397 |
| 4,772,222 | A * | 9/1988 | Laudig et al. | 439/578 |
| 4,924,179 | A * | 5/1990 | Sherman | 324/755 |
| 5,180,315 | A * | 1/1993 | Nagashima | 439/581 |
| 5,466,160 | A * | 11/1995 | Ogura | 439/63 |
| 5,482,477 | A * | 1/1996 | Michael | 439/581 |
| 5,572,688 | A * | 11/1996 | Sytwu | 710/301 |

(Continued)

FOREIGN PATENT DOCUMENTS

DE 201 18 955 U1 1/2002

(Continued)

OTHER PUBLICATIONS

International Search Report for PCT/US2007/004361 (PCT/IB2007/002130).

*Primary Examiner* — T C Patel
*Assistant Examiner* — Harshad C Patel
(74) *Attorney, Agent, or Firm* — Timothy M. Morella

(57) ABSTRACT

A connector holder has a U-shaped frame and supports an internal connector-receiving part within the U-shaped frame. Guide pieces are provided that grip the ends of a connector and the cable to which the connector is attached. The connector-receiving part thereby floats inside of the U-shaped frame so as to be positioned accurately for mounting to an opposing connector.

10 Claims, 4 Drawing Sheets

U.S. PATENT DOCUMENTS

| | | | | |
|---|---|---|---|---|
| 5,603,636 | A * | 2/1997 | Kanou et al. | 439/585 |
| 5,749,740 | A * | 5/1998 | Swift et al. | 439/92 |
| 6,030,254 | A * | 2/2000 | Johnson et al. | 439/496 |
| 6,116,914 | A * | 9/2000 | Koide | 439/63 |
| 6,386,918 | B1 * | 5/2002 | Zheng et al. | 439/607.45 |
| 6,572,407 | B1 * | 6/2003 | Ko | 439/582 |
| 6,629,181 | B1 * | 9/2003 | Alappat et al. | 710/300 |
| 6,648,653 | B2 * | 11/2003 | Huang et al. | 439/63 |
| 7,303,444 | B2 * | 12/2007 | Denpouya et al. | 439/660 |
| 7,351,067 | B2 * | 4/2008 | Chen et al. | 439/63 |
| 7,390,197 | B2 * | 6/2008 | Merz | 439/76.1 |
| 2009/0318018 | A1 * | 12/2009 | Mulfinger et al. | 439/578 |

FOREIGN PATENT DOCUMENTS

| | | | |
|---|---|---|---|
| EP | 0 579 053 | A1 | 7/1993 |
| JP | 2526329 | | 2/1997 |
| JP | 2531970 | | 4/1997 |
| WO | WO 98/31078 | A1 | 7/1998 |

* cited by examiner

FLOATING CONNECTOR HOLDER

BACKGROUND OF THE INVENTION

The present invention relates to a connector holder.

Conventionally, when a cable is connected to a substrate in small electrical equipment, such as a mobile telephone, a connector that is connected to an end of the cable is fit into a base connector secured to a circuit board such as is shown in Japanese Utility Model Registration publication No. 2526329). FIG. 5 is a schematic cross-sectional view showing such a conventional connector holder In FIG. 5, 301 designates a connector that is connected to an end of a cable 302. For example, the connector 301 is fit into a board connector 303 secured to a substrate such as a printed circuit board 304 for use in electrical equipment such as automobile instruments, so that the cable 302 will be electrically connected to conductive traces on the substrate 304. In this case, the substrate connector 303 has an insulative female housing 305, and a connecting terminal 306 disposed within the housing 305. When a male insulative housing 312 of the cable connector 301, is inserted into the female housing 305, the terminal 306 is electrically connected to an opposing terminal in the male housing 312. The female housing 305 has a guide groove 307 which engages an engaging rib 313 formed in the periphery of the male housing 312.

Here, the cable connector 301 is secured to another substrate 311 for use in electrical equipment. The one substrate 304 and the other substrate 311 are connected to each other in the electrical equipment by connecting means such as threaded bolts, screws, or the like. Consequently, a positional displacement may be induced between the cable connector 301 and the substrate connector 303. In order to absorb the positional displacement which may occur during connection, the cable connector 301 is secured to a connector holder that movably supports the cable connector 301 with respect to the other substrate 311. That is, the end of the cable 302 on the male housing 312 side is housed in a case 314 fixed to the other substrate 311 and is supported via a plurality of coil springs 315. Thus, movement of the coil springs 315 may absorb all movement of the cable connector 301 with respect to the other substrate 311.

Nevertheless, because a part of the male housing 312 of the cable connector 301 is housed within the case 314 and supported via the plurality of coil springs 315, this type of conventional connector holder is complicated in its structure and large in the size, making it impossible to use religiously in mobile telephones. Additionally, the shape of the male housing 312 is complicated and peculiar and therefore, cannot use a general connector that is commercially available. Further, due to the complicated structure, it is not easy to assemble and secure the connector holder, resulting in high cost. The present invention is directed to a cable connector holder that overcomes the aforementioned problems.

SUMMARY OF THE INVENTION

A general object of the present invention is to provide a connector holder of simple structure and small in size, that holds a coaxial connector in a manner that permits positional movement thereof with respect to a substrate, and connect easily and reliably the coaxial connector to an second connector secured to an second substrate, by having a fixing part fixed to the substrate, a holding part for holding a coaxial connector connected to a coaxial cable, and a connecting part for resiliently connecting the fixing and the holding parts together, in which the fixing part, holding part, and connecting part are formed integrally, and the coaxial connector is held in its floating state with respect to a substrate.

To this end, a connector holder of the present invention includes: a fixing part configured to be fixed to a substrate; a holding part configured to hold a coaxial connector connected to a coaxial cable; and a connecting part configured to resiliently connect the fixing part and the holding part, in which the fixing part, the holding part, and the connecting part are formed integrally, and the coaxial connector is held in its floating state with respect to a substrate.

In accordance with one embodiment of the invention, the connector holder is configured such that the fixing part, the holding part, and the connecting part are integrally formed as a metal plate forming a plane perpendicular to the substrate; the fixing part has a body parallel to the substrate and has an opening; the holding part has a body which is narrower than the opening of the body of the fixing part, and is also provided, with an opening; and, the connecting part is bent so that it connects the fixing and holding parts together so that their respective openings are identical in direction, and it connects together the right or left end of the body of the fixing part with the right or left ends of the body of the holding part.

In accordance with another embodiment of the present invention, the connector holder is configured such that the fixing and holding parts are formed in a substantial U shape.

In accordance with another embodiment of the present invention, the connector holder is configured such that the connecting part is bent in a substantial V-shape.

In accordance with a further embodiment of the present invention, the connector holder is configured such that the holding part pinches the coaxial connector along an internal wall surface of the body part.

In accordance with a still further embodiment of the present invention, the connector holder is configured such that the holding part is further provided with guide pieces that project from an upper edge of the body part thereof and which are tilted outwardly.

A general object of the present invention is to provide the connector holder so holding part with a bottom plate part that extends parallel to the substrate and supports a bottom surface of the coaxial connector.

Another object of the present invention is to provide the connector holder with a bottom plate part having a flat portion capable of permitting being contacted by a vacuum adsorption nozzle.

Still yet another object of the present invention is to provide the connector holder bottom plate part with pinching pieces that project upwardly and pinch an end of the coaxial cable, the tips of the pinching pieces being tilted outwardly.

An additional object of the present invention, the connector holder is configured to be fixed at a position adjacent to another connector mounted on the substrate.

In accordance with the present invention, a connector holder has a fixing part to be fixed to a substrate, a holding part for holding a coaxial connector connected to a coaxial cable, and a connecting part for resiliently connecting the fixing part and the holding part, in which the fixing part, the holding part, and the connecting part are formed integrally, and the coaxial connector is held in its floating state with respect to the substrate. Hence, this connector holder makes it possible to attain a simple structure and a small size, and hold a general coaxial connector in its positionally shiftable state with respect to a substrate, and reliably and easily connect the coaxial connector to an second connector secured to an second substrate.

BRIEF DESCRIPTION OF THE DRAWINGS

Reference will be had in the detailed description to the following drawings in which like reference numbers refer to like parts and in which.

DESCRIPTION OF THE PREFERRED EMBODIMENTS

Preferred embodiments of the present invention will now be described in detail with reference to the accompanying drawings.

Figure 1:
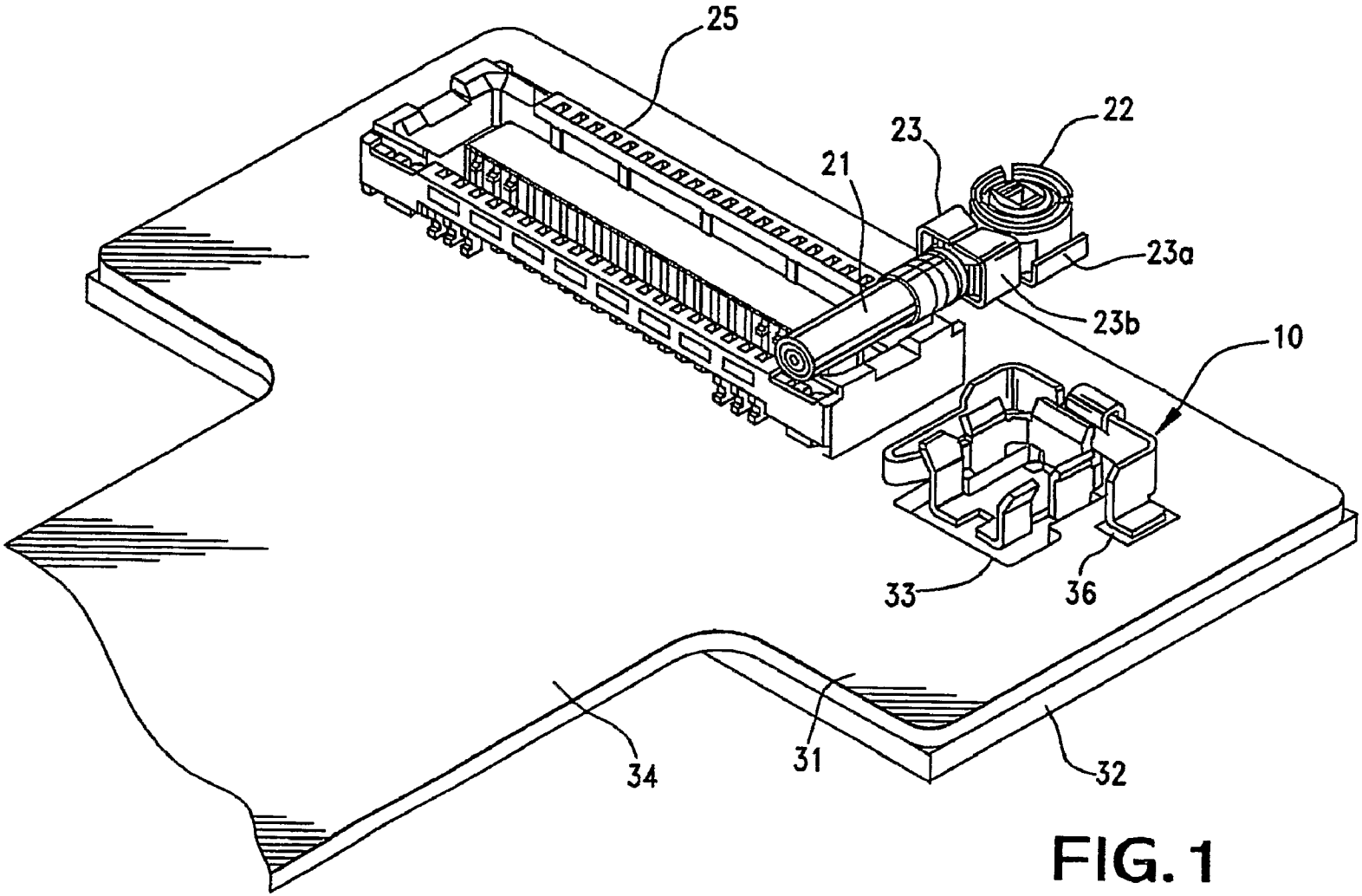
FIG. 1 is a perspective view showing a substrate, that supports a connector holder of the present invention.

In FIG. 1, 10 designates a connector holder constructed according to the principles of the present invention, and which is secured to a connecting substrate 31 in equipment such as a mobile telephone. In the preferred embodiment, the equipment may be any kind of electronic equipment, including others than a mobile telephone, such as a personal computer, a PDA (personal digital assistant), a digital camera, a video camera, a music player, a game machine, or a car navigation system.

This description includes the assumption that the above-mentioned equipment has a casing that can be divided into a plurality of portions, each of the adjacent portions being rotatably connected. As an example a mobile telephone casing can be divided into a display part casing provided with a large display screen using a liquid crystal or LED display, and an operating part casing provided with operating elements such as push buttons. In this case, in FIG. 2, 35 designates a display substrate disposed within the display part casing, and 41 designates an operating substrate disposed within the operating part casing. The connecting substrate 31 and the display device substrate 35 are connected to each other by a flexible circuit 34. This flexible circuit 34 is disposed so as to pass through a hinge part that rotatably connects the display part and the operating part cases together, and it can be arranged so as to depict a loop that can be wound around the rotation axis of the hinge part.

Preferably, the connecting substrate 31, the flexible circuit 34, and the display device substrate 35 are formed of a flat printed circuit, referred to as a flexible printed circuit (FPC), and are formed integrally. An auxiliary plate 32 formed of a rigid material such as polyimide can be attached to the region of the connecting substrate 31. In the drawings, the auxiliary plate 32 includes such a size and a shape as to cover the whole of the connecting substrate 31 and is attached to the back side of the connecting substrate 31. On the other hand, the operating part substrate 41 may be formed of a flexible circuit, as in the cases of the connecting substrate 31, the connecting wiring substrate 34 and the display device substrate 35. Alternatively, it may be comprised of a rigid material having no flexibility, as in the case of a typical printed circuit board.

A substrate connector 25 is mounted on the connecting substrate 31 at a position adjacent to the connector holder 10 in a juxtaposed manner. The substrate connector 25 is another connector, to which a plurality of signal lines, including a display signal line are connected in a manner such that the display signal line passes through the connecting wiring substrate 34 and transmits a signal for activating the display device. A coaxial connector 22 connected to an end of a coaxial cable 21 is secured to the connector holder 10.

On the other hand, a second substrate connector 43 is fit onto the substrate connector 25, and second coaxial connector 42 is fit into the coaxial connector 22, these are mounted at positions corresponding to the substrate connector 25 and the coaxial connector 22, respectively, on the operating part substrate 41. Here, the substrate connector 25 and the second substrate connector 43 constitute a pair of board-to-board connectors to be used for electrically connecting printed circuits to each other. Thus, the signal lines including the display signal line passing through the connecting wiring substrate 34 can be connected to their respective corresponding signal lines formed on the operating part substrate 41, so that a screen corresponding to the operation of an operating component provided in the operating part casing can be displayed on the display device of the display part casing.

A coaxial connector 22, which is connected to the end of the coaxial cable 21 is mounted on the connecting substrate 31 by way of the connector holder 10, and by securing it to the connector holder 10. FIG. 1 illustrates the coaxial connector 22 in a position before it is secured to the connector holder 10. In FIG. 1, the coaxial connector 22 is a right angle type connector in which the direction of connection is orthogonal to the axial of the coaxial cable 21, and is also a receptacle connector. In the present invention, the coaxial connector 22 may be of any type.

An auxiliary metal bracket, or cover 23, covers the end of the coaxial cable 21 and the lower surface of the coaxial connector 22. This auxiliary bracket 23 has flat first pinched portions 23*a*, which are disposed on opposite sides of the coaxial connector 22 and extend generally parallel to the direction of connection of the coaxial connector 22. Flat second pinched portions 23*b* are disposed around the coaxial cable 21, where it is connected to connector 22 and the flat surfaces extend in parallel with the direction of connection of the coaxial connector 22. The first pinched portions 23*a* or the second flat pinched portions 23*b* are optional structures.

Although the coaxial cable 21 may be any one used in numerous applications, this description will be provided on the assumption such that it is used as an antenna line connected to the antenna of a mobile telephone. In general, the antenna line of a mobile telephone is designed so as to transmit a high frequency signal, which is higher in frequency than a display signal line to transmit a signal for driving a display device, or the like. In order to prevent the antenna line from adversely affecting on other signals, the antenna line is preferably arranged to be isolated from other signal lines and shielded. For this reason, it is preferable to use as the antenna line a coaxial cable 21 with a center conductor whose periphery is surrounded by a shield member, and formed separately from the connecting wiring substrate 34 through which the display signal line and the like pass.

Similarly, it is also preferable that the antenna line connector is separated and isolated from the connectors of the other signal lines and is shielded. For this reason, the coaxial connector 22 has a periphery thereof surrounded by a shield member and is formed as separate and isolated from the substrate connector 25 to which are connected the signal lines, including the display signal line passing through the connecting wiring substrate 34. Similarly, mounted on the operating part substrate 41 is the second coaxial connector 42 that includes a shield member and which is formed to be separated and isolated from the second substrate connector 43 to be fit into the substrate connector 25. Thus, high frequency signals received by the antenna are transmitted to the operating part substrate 41 through the coaxial cable 21, the coaxial connector 22, and the second coaxial connector 42, without adversely affecting signals transmitted through the other signal lines.

At this stage, it might also be considered to adopt such a configuration that the coaxial cable 21 together with the other signal lines are connected to the substrate connector 25, by applying a shield for high frequencies to a part of the substrate connector 25 and a part of the second substrate connector 43. In this case, however, due to the application of the shield for high frequencies, the substrate connector 25 and the second substrate connector 43 have become complicated in structure, high in cost, and large in size. On the contrary, the present invention uses general board-to-board connectors, which are of simple structure, low cost, and small size, as the substrate connector 25 and the second substrate connector 43.

Referring to FIG. 1, it should be noted that a holder receiving recess 33 for receiving a part of the connector holder 10 is formed in the substrate 31, and a plurality of holder connecting pads 36 are located around the recess 33. The holder recess 33, however, may be omitted as required. The number and arrangement of the connecting pads 36 depends on the holder.

Figure 3:
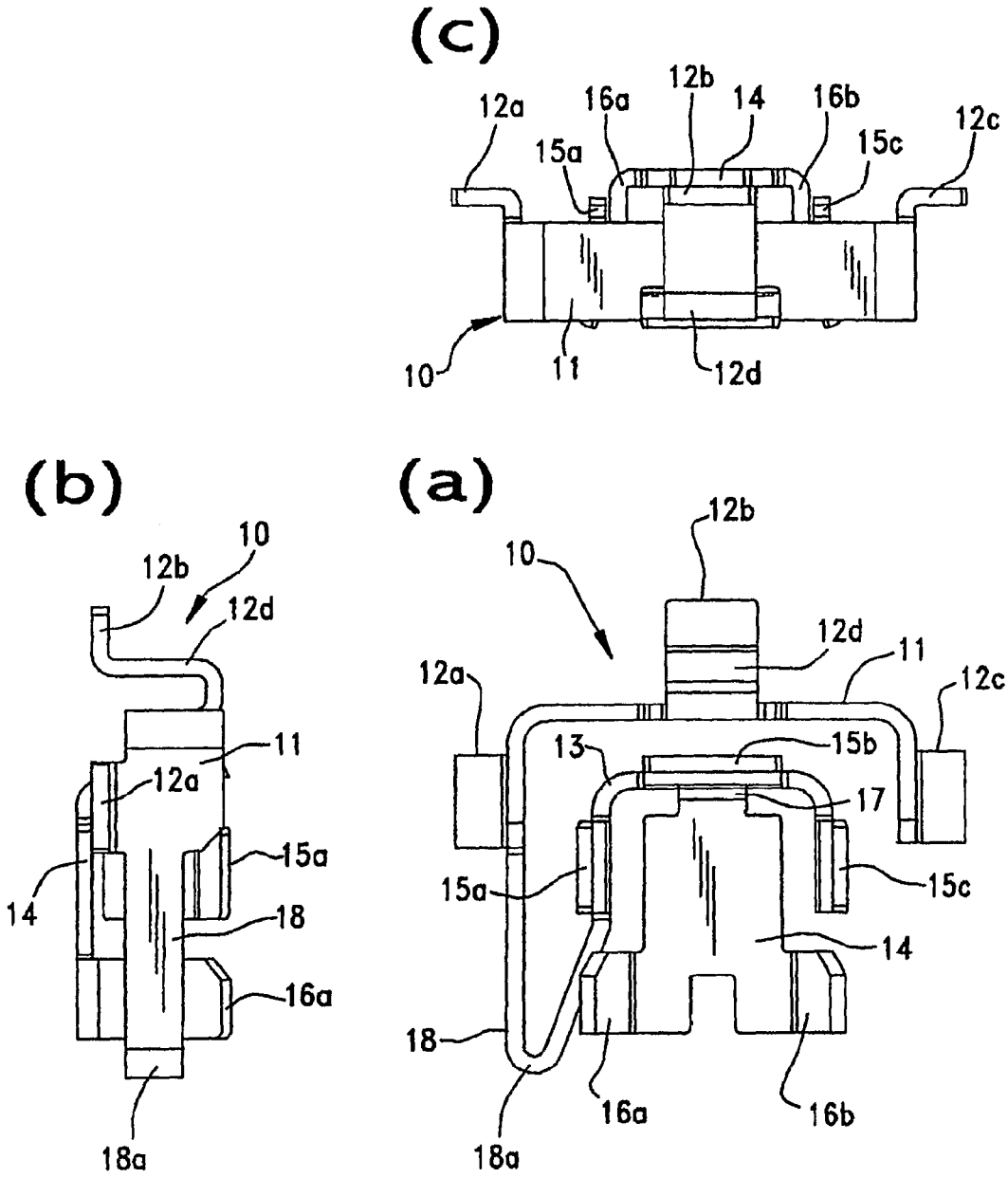
FIG. 3 is a view showing three sides of a connector holder according to the embodiment of the present invention.
Figure 4:
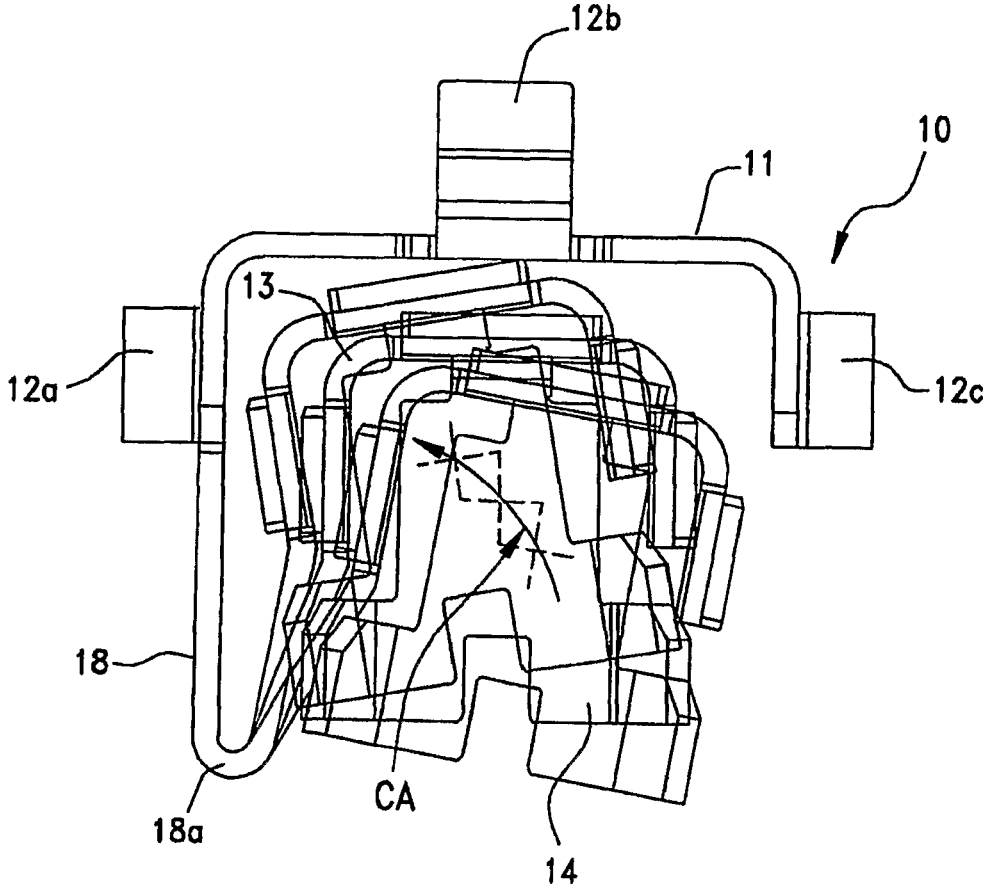
FIG. 4 is a top view showing the range of movement of the connector holder of the present invention; and, FIG. 5 is a schematic view of a conventional connector holder.
Figure 5:
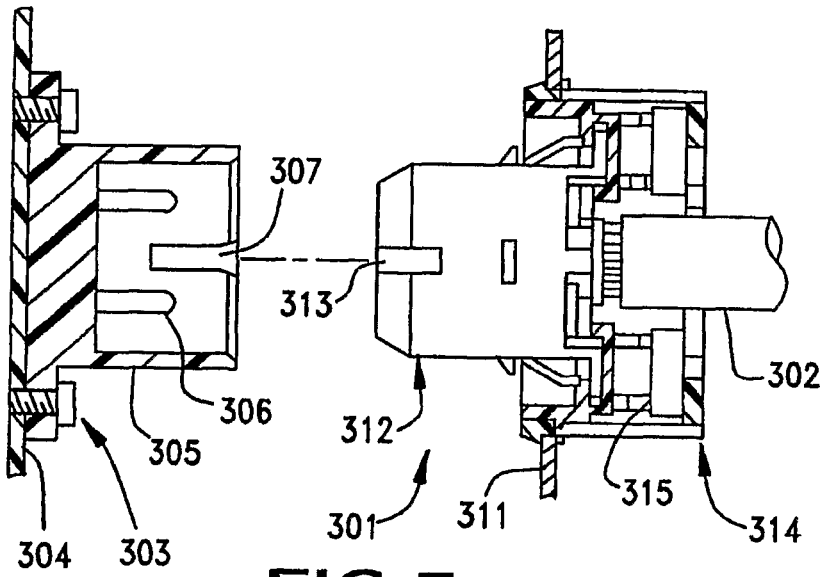
FIG. 5 (PRIOR ART)

FIG. 3 is a view showing three sides of a connector holder in a preferred embodiment of the present invention. FIG. 4 is a top view showing the range of movement of the connector holder.

Referring now to FIGS. 3 and 4, the connector holder 10 has a fixing part 11 that is fixed to the connecting substrate 31, a holding part 13 for holding the coaxial connector 22 in place, and a connecting part 18 for resiliently connecting the fixing and holding parts 11,13 together. The fixing part 11, the holding part 13, and the connecting part 18 shown are formed as a one-piece integral construction. The connector holder 10 can be manufactured by bending a metal plate to a predetermined shape. The connector holder 10 need not be made of metal, but can be made of any resiliently deformable material, such as synthetic resin.

The fixing part 11 is formed by bending a metal strip at two locations and at approximately right angles. In FIG. 3A, the fixing part 11 has the shape of a letter-U shaped body part. This body part is preferably symmetrical and has a U shape, whose shape in a cross-sectional plane parallel to the connecting substrate 31 is opened toward one direction (downwardly as viewed in FIG. 3A). The fixing part 11 has a first tail portion 12*a*, a second tail portion 12*b*, and a third tail portion 12*c*, each serves as a solder tail for fixing it to a substrate, The lower surfaces (upper surfaces as viewed in FIG. 3C) of the first, second, and third tail portions 12*a*, 12*b*, and 12*c* are connected to the connecting pads 36 by means such as solder. In FIG. 3A, the second tail portion 12*b* is disposed longitudinally centrally of the fixing part 11, and the first tail portion 12*a* and the third tail portion 12*c* are preferably symmetrically disposed on the left and right sides, respectively. Hence, the connection of the first, second, and third tail portions 12*a*, 12*b*, and 12*c* with their respective corresponding holder connecting pads 36 stabilizes the position of the fixing part 11 fixed to the connecting substrate 31. In the following description, it should be noted that the first, second, and third tail portions 12*a*, 12*b*, and 12*c* maybe generically described as tails, collectively.

The reason why the fixing part 11 is of the substantial Ur shape is that a connector holding part 13 also has a substantial U-shape. Thus, the similarity in shape between the holding and fixing parts 11,13 ensures a provision of a moving range for enabling the connector holding part 13 to be efficiently moved. The connecting part 18 is connected so that the direction of the opening of the fixing part 11 and that of the holding part 13 coincide and take up substantially parallel positions. If the distance between the fixing part 11 and the holding part 13 is sufficiently large, these parts may not be of the identical shape. For example, the fixing part 11 may be formed in a substantially arcuate shape.

In the drawings, the first and third tail portions 12*a* and 12*c* are shown as formed by bending a tongue projecting from the lower edge of the body part of the fixing part 11 to project outwardly. The second tail portion 12*b* is similarly formed by bending the lower end of an elongated tail connecting portion 12*d* outwardly. Alternatively, like the first and third tail portions 12*a* and 12*c*, the second tail portion 12*b* may also be formed by bending the tongue at the lower edge of the body part of the fixing part 11 outwardly. The number and arrangement of the tail portions 12 can be changed to suit the number and arrangement of the connecting pads 36.

To form the first, second and third tail portions 12*a*, 12*b* and 12*c*, the tongues are bent outwardly of the fixing part 11 in order to comply with reflow soldering. Alternatively, the tongue may be projected down from the fixing part 11 to the substrate in order to comply with dip soldering. In this case, instead of the holder connecting pads 36, through-holes that permit the insertion of a projecting portion into the back side of the substrate may be provided, and soldering may be performed on the back side of the substrate.

The holding part 13 can also be formed by bending a metal strip at two locations and at right angles. In FIG. 3A, the holding part 13 also has a substantial U-shaped body part. More specifically, this body part is symmetrical and in a substantially U-shape, whose shape in a cross-sectional plane parallel to the connecting substrate 31 is opened in the same direction as the body part of the fixing part 11, and has a substantially U-shape narrower than the body part of the fixing part 11. In other words, the U-shape of the holding part 13 is oriented, or offset 90° from that of the fixing part 11. The holding part 13 has a first guide portion 15*a*, a second guide portion 15*b*, and a third guide portion 15*c*, each of which is a guide piece for guiding the coaxial connector 22 into the holding part 13. The first, second, and third guide pieces 15*a*, 15*b*, and 15*c* are formed by bending a tongue that projects from an upper edge of the body part of the holding part 13 so as to tilt outwardly. They are provided as members for facilitating smooth insertion of the coaxial connector 22 into the holding part 13 on the side thereof receiving the coaxial connector 22 is formed to be tapered.

When the coaxial connector 22 is secured to the connector holder 10 by moving it downward as shown in FIG. 1, the first pinched portions 23*a* of the auxiliary bracket 23 at each side of the coaxial connector 22 are moved down while abutting against the tilted surfaces of the first and third guide portions 15*a* and 15*c*. Thus, they are positioned in such a manner as to be positioned centrally in the holding part 13. Similarly, the edge of the tip of the coaxial connector 22 (the end on the opposite side of the coaxial cable 21) is moved down while being abutting against the tilted surface of the second guide portion 15*b* and thus, it is positioned in such a manner as to be positioned centrally in the body part of the holding part 13. In the state of completion of the securing of the coaxial connector 22 to the connector holder 10, the first pinched portions 23*a* of the auxiliary brackets 23 are pinched from both sides with the internal wall surface of the body part of the holding part 13, allowing the coaxial connector 22 to be certainly held.

The holding part 13 further has a bottom plate part 14, which is connected centrally of its body part to its lower edge through a bottom plate connecting part 17 of substantial L-shape. The bottom plate part 14 is preferably a flat member that supports the bottom part of the coaxial connector 22 held by the holding part 13, and it extends parallel to the connecting substrate 31, the direction being orthogonal to the holding part 13. The bottom plate part 14 has a first pinching portion 16*a* and a second pinching portion 16*b*, connected one to each side of the tip of the bottom plate part 14 (its lower end as viewed in FIG. 3A). The first and second pinching portions 16*a* and 16*b* are formed by bending a tongue projecting from each side of the tip of the bottom plate part 14 to extend upwardly, and they are provided as members for pinching, from opposite sides, the second pinched portion 23*b* of the auxiliary brackets 23 at each side at the end of the coaxial cable 21. The tips of the first and second pinching portions 16*a* and 16*b* are tapered to facilitate the coaxial connector 22 to be in position in the holding part 13.

When the coaxial connector 22 is secured to the connector holder 10 the second pinched portions 23*b* of the auxiliary brackets 23 at each side of the end of the coaxial cable 21 move down while abutting against the tilted surfaces of the tips of the first and second pinching portions 16*a* and 16*b*. Thus, they are positioned to be centrally received in the holding part 13. When the coaxial connector 22 is secured in to the connector holder 10, the second pinched portions 23*b* of the auxiliary brackets 23 are pinched from both sides with the internal wall surfaces of the first and second pinching portions 16*a* and 16*b*, so that the ends of the coaxial connector 22 and the coaxial cable 21 are reliably held.

Although the size of the bottom plate part 14 can vary, it is preferable that the flat portion permits contact by a vacuum absorption nozzle attached to the robot arm so that the connector holder 10 can be handled by using an automatic mounting device. The bottom plate part 14 is shown formed and positioned lower than the tail portions 12. However, the position in the direction of the height of the bottom plate part 14 (a lateral direction as viewed in FIG. 3B) may be higher than the tail portions 12, and this position can be adjusted suitably in order to adjust the position in the direction of the height of the coaxial connector 22 secured to the connector holder 10. That is, by adjusting the height of the bottom plate part 14, the position of the coaxial connector 22 in the direction of height thereof can be appropriately adjusted so as to be fit into the second coaxial connector 42, in the state in which the substrate connector 25 is fit into the second substrate connector 43.

As a result of such an adjustment, if the bottom plate part 14 is lower than the tail portions 12, as shown in FIG. 1, the holder receiving recess part 33 is formed in the connecting substrate 31 so that the lower part of the holding part 13 is held within the holder recess 33. In this case, it is preferable that the depth of the holder recess 33 is such that the lower surface of the bottom plate part 14 does not contact the bottom surface of the holder recess 33. It is also preferable to set the space of the holder recess 33 so as to fully allow the holding part 13 to move in a direction parallel to the upper surface of the connecting substrate 31.

The connecting part 18 can be formed by bending a metal plate at bending portion 18*a* and at an acute angle. Its both ends are connected to the ends of the fixing and holding parts 11,13, respectively. More specifically, the connecting part 18, whose shape in a cross-sectional plane taken parallel to the connecting substrate 31 is a substantially V-shape, connects the right or left end in the body part of the fixing part 11 with the right or left end in the body part of the holding part 13. The plate forming the connecting part 18 is narrower in width and lower in rigidity, and therefore more apt to be resiliently deform than the plate forming the fixing part 11. Therefore, if, in the state in which the fixing part 11 is secured to the connecting substrate 31, the force is applied to the holding part 13 in a lateral direction, namely in a direction parallel to the upper surface of the connecting substrate 31, and the connecting part 18 is resiliently deformed, allowing the holding part 13 to move parallel to the upper surface of the connecting substrate 31, as shown in FIG. 4.

Here, the bending of the bending portion 18*a* in the substantially V-shape will increase the distance of the bending portion to the first pinching portion 16*a*. Therefore, if the distance between the first and second pinching portions 16*a* and 16*b* is increased, the amount of movement of the holding part 13 can be increased. For example, if the distance between these pinching portions is increased with a slightly large connector, there is no possibility of preventing the movement of the holding part 13.

Where the second pinched portions 23*b* of the coaxial connector 22 are small in size that the spacing between the first and second pinching portions 16*a* and 16*b* may be narrower, the bending portion 18*a* may be bent in a U-shape so that the bending portion 18*a* and the first guide portion 15*a* are arranged in parallel. The U-shape provides a long deflection portion, so that the flexibility of the connecting part 18 can be increased more than if it were bending in V-shape.

In FIG. 4, for illustration purposes, only the bending portion 18*a* is deformed, and the locus of the holding part 13 during its movement draws a circular arc around the bending portion 18*a* as shown by line CA in FIG, 4. In fact, the portions other than the bending portion 18*a* in the connecting part 18 are also deformable, thereby allowing the holding part 13 to move in more many directions and over a wider range. The moving ranges of the holding part 13 in the upward direction and the lateral direction as viewed in FIG. 4 are limited by the abutment of the holding part 13 against the fixing part 11, and the moving ranges in the downward direction and the lateral direction as viewed in FIG. 4 are limited by the abutment of the holding part 13 against the edge of the holder recess 33. Hence, the size of the fixing part 11, the distance from the holding part 13, and the spacing of the holder recess 33 govern the moving ranges of the holding part 13. Since the connecting part 18 is disposed so that its cross section is a vertically long rectangle, the geometrical coefficient of inertia in vertical bending is large, making it difficult to deform vertically. As a result, the holding part 13, even if the force is applied thereto, does not excessively shift vertically, namely in a direction perpendicular to the upper surface of the connecting substrate 31.

Next, securing of the coaxial connector 22 to the connector holder 10 will be described.

In FIG. 1, the connector holder 10 is mounted in advance on the connecting substrate 31 by using an automatic mounting device for use in mounting, because the bottom plate part 14 can be contacted by a vacuum adsorption nozzle attached to the tip of a robot arm or the like.

An operator manually connects the coaxial cable 21 with the coaxial connector 22, so that the lower surface of the coaxial connector 22 is directed immediately downward and positioned above the connector holder 10 mounted on and secured to the connecting substrate 31, as shown in FIG. 1. Here, the direction of the coaxial connector 22 is adjusted so that the direction of extension of the coaxial cable 21 is the opposite direction of the fixing part 11, namely the direction of opening of the holding part 13 of substantially U-shape.

Subsequently, the coaxial connector 22 is moved downward, and inserted into the holding part 13 and secured thereto. In this case, the first pinched portions 23*a* of the auxiliary brackets 23 are moved downwardly while abutting the tilted surfaces of the first and third guide portions 15*a* and 15*c*. They are positioned as to be guided and positioned centrally in the holding part 13. The edge of the tip of the coaxial connector 22 is moved down while abutting against the tilted surface of the second guide portion 15*b* and thus, it is positioned in such a manner as to be positioned centrally in the body part of the holding part 13. The second pinched portions 23*b* of the auxiliary brackets 23 are moved down while abutting against the tilted surfaces of the tips of the first and second pinching portions 16*a* and 16*b*. They are positioned to be guided and positioned centrally in the holding part 13. Accordingly, the coaxial connector 22 is easily secured so that it is accurately placed in position with respect to the holding part 13. If there is a positional shift between the coaxial connector 22 and the holding part 13, the movement of the holding part 13 in the direction parallel to the upper surface of the connecting substrate 31 permits absorption of the positional shift, allowing the coaxial connector 22 to be secured more readily to the holding part 13.

When the coaxial connector 22 is secured in the connector holder 10, the first pinched portions 23*a* of the auxiliary brackets 23 are held and pinched from both sides with the internal wall surface of the holding part 13, and the second pinched portions 23*b* are held and pinched from both sides with the internal wall surfaces of the first and second pinching portions 16*a* and 16*b*, so that the ends of the coaxial connector 22 and the coaxial cable 21 are reliably held. Thus, the coaxial connector 22 is mounted on the connecting substrate 31 through the connector holder 10. While the foregoing description has been made of the case where the coaxial connector 22 is moved with respect to the connecting substrate 31, the connecting substrate 31 may be moved with respect to the coaxial connector 22.

The following describes fitting the coaxial connector 22 mounted on the connecting substrate 31 into the second coaxial connector 42 mounted on the operating part substrate 41.

Figure 2:
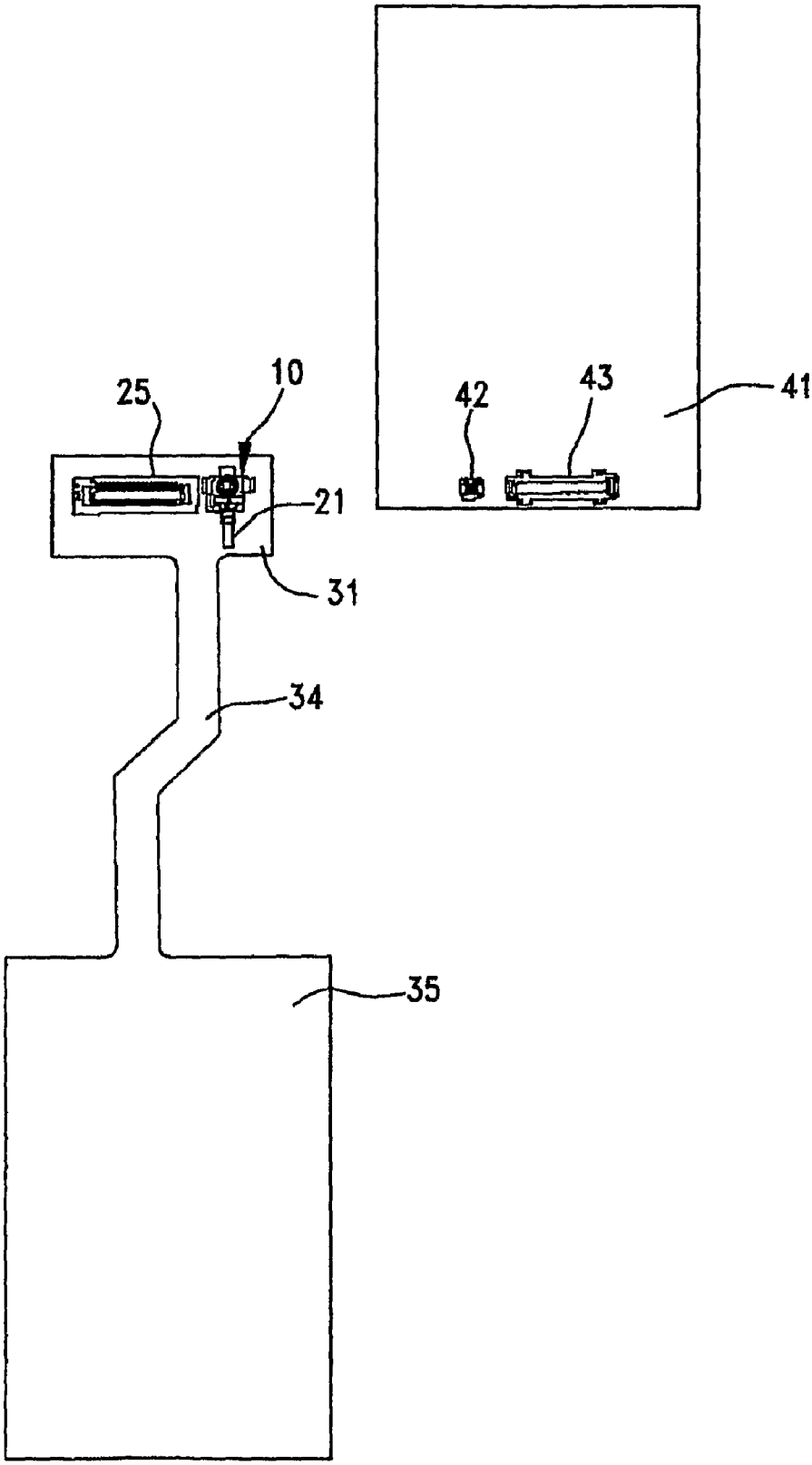
FIG. 2 is a plan view showing a substrate and an second substrate, to which is applied a connector holder according to the embodiment of the present invention.

First, the operator manually reverses the operating part substrate 41, on which the second substrate connector 43 and the second coaxial connector 42 are mounted as shown in FIG. 2, so that the second substrate connector 43 and the second coaxial connector 42 are facing down. Then, the operating part substrate 41 is shifted to such a position that the second substrate connector 43 and the second coaxial connector 42 confront to the substrate connector 25 and the coaxial connector 22 mounted on the connecting substrate 31, respectively.

The operator then allows the operating part substrate 41 to shift toward the connecting substrate 31, so that the second substrate connector 43 and the second coaxial connector 42 are fit into the substrate connector 25 and the coaxial connector 22, respectively. Thus, one operation permits simultaneous fitting between the substrate connector 25 and the second substrate connector 43, and between the coaxial connector 22 and the second coaxial connector 42. This results in improvement in the operability.

In some cases, the relative positional relationship between the substrate connector 25 and the coaxial connector 22 mounted on the connecting substrate 31 might not strictly be in coincidence with the relative positional relationship between the second substrate connector 43 and the second coaxial connector 42 mounted on the operating part substrate 41. In such a case, when the substrate connector 25 and the second substrate connector 43 are used as reference, a positional discrepancy is involved between the coaxial connector 22 and the second coaxial connector 42, resulting in a positional deviation between the coaxial connector 22 and the second coaxial connector 42. However, the movement of the holding part 13 in the direction parallel to the upper surface of the connecting substrate 31 can absorb such a positional deviation, thereby allowing the coaxial connector 22 to be readily and reliably fit into the second coaxial connector 42.

While the foregoing description has been made of the case where the operating part substrate 41 is shifted with respect to the connecting substrate 31, the connecting substrate 31 may also be shifted with respect to the operating part substrate 41.

Thus, in the present preferred embodiment, the connector holder 10 has the fixing part 11 to be fixed to the connecting substrate 31, the holding part 13 for holding the coaxial connector 22 connected to the coaxial cable 21, and the connecting part 18 for resiliently connecting the fixing part 11 and the holding part 13, in which the fixing part 11, the holding part 13, and the connecting part 18 are formed integrally, and the coaxial connector 22 is held in its floating state with respect to the connecting substrate 31. This provides the connector holder 10 of simple structure and small size. In addition, the general coaxial connector 22 can be held in its movable state with respect to the connecting substrate 31, allowing the coaxial connector 22 to be connected reliably and readily to the second coaxial connector 42 secured to the operating part substrate 41.

The fixing part 11 has the symmetrical body part, whose shape in a cross-sectional plane parallel to the connecting substrate 31 is the U-shape, which is opened toward one direction. The holding part 13 has the symmetrical body part, whose shape in the cross section parallel to the connecting substrate 31 is the U-shape, which is opened toward the same direction as the body part of the fixing part 11, and is narrower than the body part of the fixing part 11. The connecting part 18, whose shape in the cross section parallel to the connecting substrate 31 is a V-shape, connects the right or left end in the body part of the fixing part 11 with the right or left end in the body part of the holding part 13. Hence, the overall attitude of the connector holder 10 fixed to the connecting substrate 31 can be stabilized. Additionally, the holding part 13 is capable of shifting in any direction and over a wide range, without interfering with the fixing part 11.

The holding part 13 pinches the coaxial connector 22 with the internal wall surface of the body part thereof. Therefore, the coaxial connector 22 is also detachable from the connector holder 10, as required.

Further, the holding part 13 has the guide portions 15 projecting from the upper edge of the body part thereof and being tilted outwardly. Therefore, when the coaxial connector 22 is secured to the connector holder 10, it shifts while being abutted against the tilted surfaces of the guide portions 15, whereby the coaxial connector 22 can be positioned in such a manner as to be guided and positioned centrally in the holding part 13.

Further, the holding part 13 has the bottom plate part 14 that extends in parallel with the connecting substrate 31 and supports the bottom surface of the coaxial connector 22. It is, therefore, possible to stabilize the position of the coaxial connector 22. By adjusting the height of the bottom plate part 14, the height of the coaxial connector 22 secured to the connector holder 10 can be adjusted for permitting appropriate fitting of the coaxial connector 22 into the second coaxial connector 42, in the state in which the substrate connector 25 is fit into the second substrate connector 43.

The bottom plate part 14 has a flat portion to permit installation by a vacuum nozzle. Therefore, the connector holder 10 can be easily mounted on the connecting substrate 31 by using automatic mounting devices.

Further, the bottom plate part 14 has pinching portions 16 that project upwardly and pinch the end of the coaxial cable 21, and the tips of the pinching portions 16 are tilted outwardly. Therefore, because the end of the coaxial cable 21 can also be pinched, the direction of the coaxial connector 22 remains unchanged thereby to stabilize the attitude of the coaxial connector 22. In addition, when the end of the coaxial cable 21 is secured to the connector holder 10, it moves while abutting against the tilted surfaces of the tips of the pinching portions 16, whereby the end of the coaxial cable 21 is positioned centrally in the holding part 13.

The connector holder 10 is manufactured by bending a metal plate. This provides easy manufacturing and less manufacturing cost. In the case where the holder connecting pads 36, to which the tail portions 12 of the fixing part 11 are connected, are being connected to ground lines, the shield member around the coaxial connector 22 can be grounded by the ground lines through the connector holder 10 and the holder connecting pads 36.

Further, the connector holder 10 is fixed at a position adjacent to the substrate connector 25 mounted on the connecting substrate 31. Therefore, one operation permits the simultaneous fitting between the substrate connector 25 and the second substrate connector 43, and between the coaxial connector 22 and the second coaxial connector 42. This can improve the operability of the operation of connecting the connecting substrate 31 and the operating part substrate 41. Additionally, the signals such as the high frequency signal transmitted by the coaxial cable 21 can be transmitted through the coaxial connector 22 and the second coaxial connector 42 to the operating part substrate 41, without adversely affecting the signals transmitted through the other signal lines connected to the substrate connector 25. It is, therefore, possible to use the general board-to-board connectors, which are of simple structure, low cost, and small in its size, as the substrate connector 25 and the second substrate connector 43.

It is to be understood that the present invention is not limited to the foregoing preferred embodiment but is variously changed and modified by a person skilled in the art, based on the concept of the present invention, without departing from the scope and sprit of the present invention claimed in the attached claims.

What is claimed is:

1. A connector holder comprising:

a fixing part, the fixing part being affixed to a substrate;

a holding part, the holding part being adapted for holding a connector connected to an end of a cable; and a connecting part, the connecting part resiliently connecting the fixing and holding parts together;

wherein:

the fixing, holding and connecting parts are integrally formed together as one piece; and the connector is held in a floating state with respect to the substrate and is capable of limited movement within the fixing part in a circular arc, the circular arc being in a plane parallel to the substrate and extending from a first position, proximate a connection point where the fixing and connecting parts meet, and a second position, distal from the connection point.

2. The connector holder of claim 1, wherein:

the fixing, holding and connecting parts are integrally formed from a metal plate, the metal plate defining a plane perpendicular to the substrate;

the fixing part has a body whose shape in a cross-sectional plane parallel with the substrate is provided, in part thereof, with an opening;

the holding part has a body whose shape in a cross sectional plane parallel with the substrate is narrower than the opening of the body of the fixing part, and is provided, in part thereof, with an opening; and the connecting part, whose shape in a cross sectional plane parallel with the substrate has a predetermined bent shape to connect the fixing part and the holding part so that their respective openings are identical in direction, connects the right or left end in the body of the fixing part with the right or left end in the body of the holding part.

3. The connector holder of claim 2, wherein the fixing and holding parts are formed in substantial U shape.

4. The connector holder of claim 2, wherein the connecting part is bent in substantial V shape.

5. The connector holder of claim 2, wherein the holding part holds and pinches the connector with an internal wall surface of the body thereof.

6. The connector holder of claim 5, wherein the holding part has guide pieces projecting from an upper edge of the body thereof and are tilted outwardly.

7. The connector holder of claim 1, wherein the holding part has a bottom plate that extends parallel to the substrate and supports a bottom surface of the connector.

8. The connector holder of claim 7, wherein the bottom plate has a flat portion capable of permitting contact therewith by a vacuum adsorption nozzle.

9. The connector holder of claim 7, wherein the bottom plate has pinching pieces that upwardly project and pinch an end of the cable, and the tips of the pinching pieces are tilted outwardly.

10. The connector holder of claim 1, wherein the connector is fixedly arranged at a position adjacent to another connector mounted on the substrate.

* * * * *